US006837690B2

(12) United States Patent
Schreiber et al.

(10) Patent No.: US 6,837,690 B2
(45) Date of Patent: Jan. 4, 2005

(54) ROTARY PUMP WITH INTEGRAL HAND PUMP UNIT

(75) Inventors: Joachim Schreiber, Bad Homburg (DE); Karsten Schnittger, Bad Homburg (DE)

(73) Assignee: Luk Fahrzeug-Hydraulik GmbH & Co. KG, Bad Homburg (DE)

( * ) Notice: Subject to any disclaimer, the term of this patent is extended or adjusted under 35 U.S.C. 154(b) by 64 days.

(21) Appl. No.: 10/257,659

(22) PCT Filed: Apr. 17, 2001

(86) PCT No.: PCT/DE01/01476

§ 371 (c)(1),
(2), (4) Date: Oct. 16, 2002

(87) PCT Pub. No.: WO01/79684

PCT Pub. Date: Oct. 25, 2001

(65) Prior Publication Data

US 2003/0059311 A1 Mar. 27, 2003

(30) Foreign Application Priority Data

Apr. 18, 2000 (DE) ..... 200 22 349 U

(51) Int. Cl.[7] ..... F04B 23/08
(52) U.S. Cl. ..... 417/199.2; 417/205
(58) Field of Search ..... 417/85, 199.1, 417/199.2, 205, 217, 374, 425, 286, 287; 123/495, 496, 497, 500, 501, 505, 510, 527; 60/415, 473

(56) References Cited

U.S. PATENT DOCUMENTS

| | | | | |
|---|---|---|---|---|
| 2,185,145 A | | 12/1939 | Edwards | |
| 2,189,674 A | * | 2/1940 | Parker | 417/286 |
| 2,234,924 A | * | 3/1941 | Green | 417/63 |
| 2,279,403 A | * | 4/1942 | Kottmann | 417/425 |
| 4,565,629 A | | 1/1986 | Wilson et al. | |
| 5,307,770 A | * | 5/1994 | Davis et al. | 123/179.11 |
| 5,363,666 A | * | 11/1994 | Tieken | 62/129 |
| 5,620,309 A | * | 4/1997 | Todden et al. | 417/199.2 |
| 6,186,746 B1 | * | 2/2001 | Bodzak et al. | 417/199.2 |

FOREIGN PATENT DOCUMENTS

| | | |
|---|---|---|
| DE | 2 253 331 | 5/1974 |
| DE | 198 57 560 A1 | 6/1999 |
| FR | 79 223 | 2/1963 |
| WO | WO 83/02980 A1 | 9/1983 |

* cited by examiner

*Primary Examiner*—Charles G. Freay
(74) *Attorney, Agent, or Firm*—Alston & Bird LLP

(57) ABSTRACT

A pump, such as a rotary vane pump, roller cell pump, or gear pump for delivering diesel fuel, with a pump housing and a pumping unit that is arranged in the pump housing and driven for rotation via the drive shaft of a motor. The pump housing has an intake and an outlet, and the pump further has a hand pump unit that is integrally joined to the pump housing and delivers the fuel into the intake of the pump housing and thus into the flow path of the pumping unit.

11 Claims, 2 Drawing Sheets

ROTARY PUMP WITH INTEGRAL HAND PUMP UNIT

BACKGROUND OF THE INVENTION

The present invention relates to a pump, preferably rotary vane pump or gear pump, in particular for delivering diesel fuel, with a pump housing and a pumping unit that is arranged in the pump housing and preferably driven for rotation via the drive shaft of a motor, with the pumping unit comprising an intake area.

Pumps of the described type, such as, for example rotary vane pumps, are already known from practice, for example, DE 198 57 560 A1.

Pumps of the type under discussion, are designed and constructed, for example, as rotary vane pumps or gear pumps. They are used for delivering a flowable medium, namely gaseous or liquid media. The pumping unit of the pump comprises a rotor, which in turn is driven via a pump shaft. In general, the pump shaft is coupled via a clutch with a drive shaft, such as a camshaft of a motor. Within the pump housing, the pump shaft is supported for rotation with the aid of bearings.

Pumps of the described type are used, among other things, for delivering diesel fuel in automobiles. Provided that air is in the system, i.e., for example, for a first-time operation, or after a tank is emptied, it will be imperative to prime the pump with the flow medium that is to be delivered, in this instance, diesel fuel, to realize a delivery in any event. To this end, it has until now been common to use separate hand pumps, which precede the actual pump. In the past, such a hand pump was accommodated in a separate housing, and was used to deliver the diesel fuel directly into the actual pump, which required a separate connection line.

However, the provision of a hand pump as realized in the past in combination with a pump used for delivering diesel fuel is problematic in practice, since as a separate component, the hand pump causes considerable expenses for assembly and maintenance. Additionally required connection lines and connections increase not only the assembly expense, but also the expense for material, and lead as a whole to a very substantial cost increase in comparison with merely providing the pump alone. Because of the stringent need for a hand pump, it has until now been necessary to accept this kind of expenditure.

It is therefore an object of the present invention to improve and further develop a pump, preferably a rotary vane pump or gear pump, in particular for delivering diesel fuel in such a manner that, while accepting the need for a hand pump, it is possible to reduce expenses for assembly and material and, thus, the costs to quite a significant extent. Nonetheless, it is still necessary to ensure a reliable operation.

SUMMARY OF THE INVENTION.

The above and other objects and advantages of the invention are achieved by the provision of a rotary pump for delivering a fluid such as diesel fuel, and which has a pump housing which includes an intake and an outlet. A rotary pumping unit is mounted for rotation in the pump housing for delivering the fluid from the intake to the outlet. Also, the pump includes a hand pump unit, which is integrated into the pump housing and delivers the fluid into the intake of the housing and thus into the flow path of the pumping unit.

In accordance with the invention, one has totally departed from the state of the art as known from practice, namely, providing a separate hand pump unit. Instead, one has selected an integral solution by integrating the absolutely needed hand pump unit into the pump housing, thereby eliminating connections and additional lines. Already this quasi monolithic configuration of the pump and hand pump unit reduces assembly costs quite considerably. Moreover, it realizes a compact construction.

Furthermore, in accordance with the invention, the hand pump unit is integrated not only into the pump housing, but also arranged in the pump housing in such a manner that on the intake side, the hand pump unit delivers directly into the flow path of the pumping unit. Consequently, it is now possible to operate the hand pump unit directly on the pump housing and to advance the fluid to be delivered on the shortest way via the hand pump unit directly into the pumping unit, without additional connections, delivery lines, or the like. The here realized compact construction reduces the assembly cost, decreases the susceptibility of the functional elements to repair, and thus the cost of maintenance.

In an advantageous manner, the hand pump unit delivers not only into the flow path of the pumping unit, but also directly into the intake area of the pumping unit, thereby enabling a considerable reduction of flow resistances on the intake side. This measure makes it possible to minimize the delivery distance between the hand pump unit and the pumping unit of the pump, thereby favoring again a compact construction.

Normally, pumps of the described type for delivering diesel fuel are mounted to a crankcase. To this end, the pump housing is provided on the drive side with a pump flange for mounting to the crankcase. Within the scope of such a construction, it would be possible to integrate the hand pump unit into the pump flange as an integral part of the actual pump housing, so that the hand pump unit is arranged at least slightly offset relative to the pumping unit.

In a further advantageous manner, the hand pump unit projects at least slightly or in part from the pump housing or pump flange, preferably with an actuation element that is suitable for manual operation. In this case, it would be possible to provide a hand knob or the like, with the actuation element being adapted for engaging in its idle position a housing part, preferably for being locked or screwed in place. Only as a manual operation becomes necessary, will the actuation element be released from its idle position. It can then be moved or actuated for operating the hand pump unit.

In a further advantageous manner, the hand pump unit comprises an external suction inlet, through which the hand pump unit receives a flow medium. Specifically, the hand pump unit could be configured such that in its idle position, it is used only for the passage of the flow medium, so that no separate suction inlet is needed for the actual pump. In this respect, it would be possible to use the hand pump unit as a continuous line segment leading right into the pumping unit of the pump. This continuous line segment can be used as an active hand pump upon activation of the hand pump unit. Likewise in this respect, it is possible to reduce both construction and assembly costs to quite a considerable extent.

The suction inlet of the hand pump unit and, if need be, the suction inlet of the pump could be an integral part of the housing, preferably the housing portion of the hand pump unit. This housing portion in turn may be a part of the pump flange, and thus a part of the pump housing. Many other configurations and arrangements are possible.

Likewise in the light of a compact construction, it will be of advantage, when the suction inlet of the hand pump unit is formed in the vicinity of the actuation element, so that the fluid is able to enter the hand pump unit directly from the suction inlet, and to reach from there directly the pumping unit of the pump. As described in the foregoing, the shortest distances are of advantage, on the one hand for decreasing flow resistances, and on the other hand for reducing constructional expenditure and for assisting an always desired miniaturization.

In one embodiment, the hand pump unit comprises a cylinder-piston arrangement, which serves to advance the fluid. The actuation element is used for reciprocating the piston of the hand pump unit in approximately orthogonal relationship with the axis of rotation of the pumping unit of the pump. In this case, the cylinder-piston arrangement, in particular the piston could be designed and constructed similarly to the pumping unit of a bicycle pump. In the idle position of the hand pump unit, the piston could be totally moved out of the cylinder, so that the cylinder forms an unobstructed passageway for the flow medium. Only as the piston is retracted into the cylinder, will it be possible to actuate the hand pump unit as such.

There exist various possibilities of improving and further developing the teaching of the present invention in an advantageous manner. To this end, one may refer to the following detailed description of an embodiment of the invention with reference to the drawing. In conjunction with the detailed description of the preferred embodiment of the invention with reference to the drawing, also generally preferred improvements and further developments of the teaching are explained.

DETAILED DESCRIPTION OF THE PREFERRED EMBODIMENT

Figure 1:
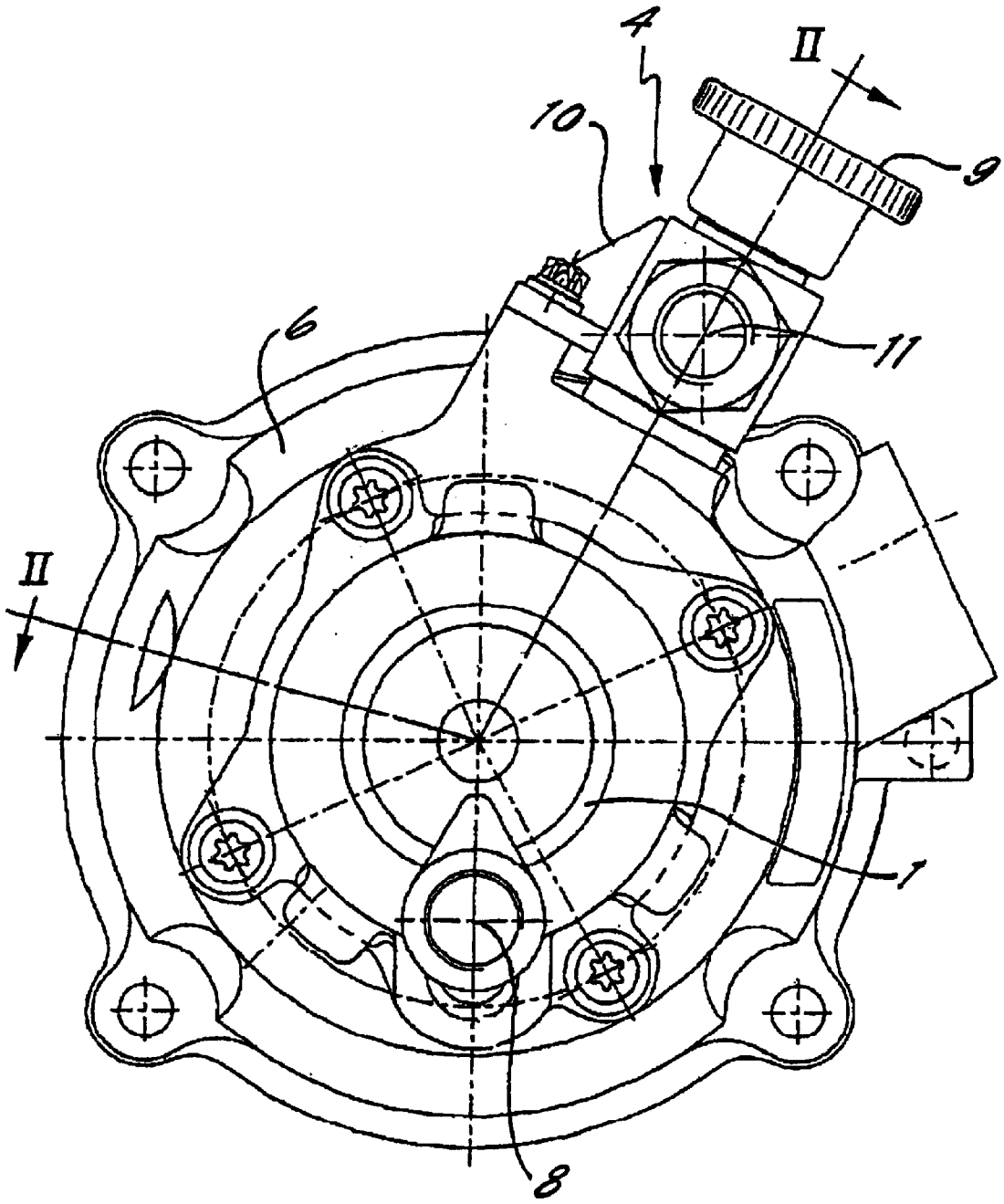
FIG. 1 is a front view of an embodiment of a pump according to the invention with an integrated hand pump unit.
Figure 2:
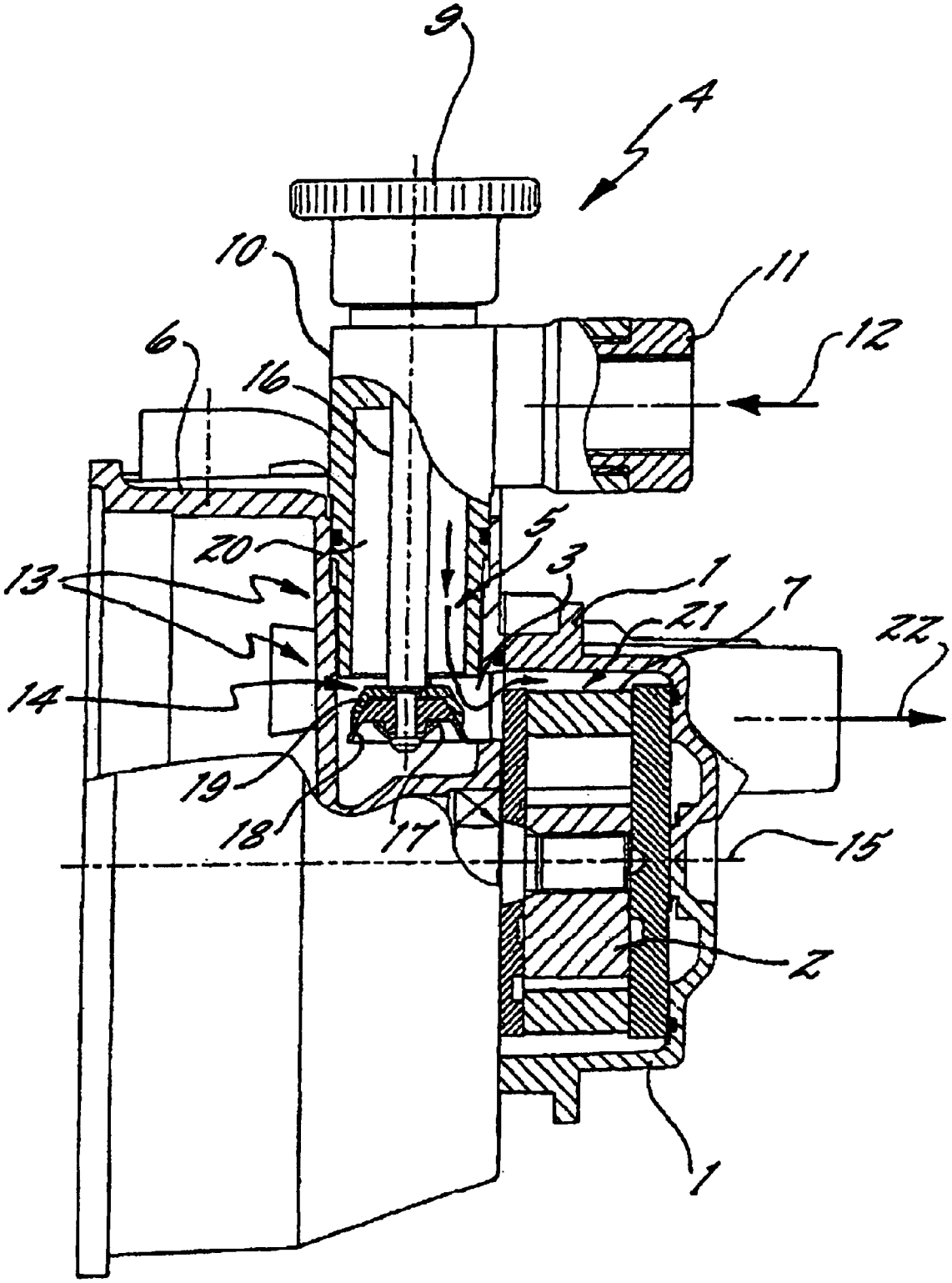
FIG. 2 is a sectional view of the embodiment of FIG. 1 taken along the line II—II of FIG. 1.

Together, FIGS. 1 and 2 show an embodiment of the pump according to the invention. In the case of the merely arbitrarily selected embodiment, the pump is a rotary vane pump. This pump is used to deliver diesel fuel, and it comprises a pump housing 1 and a pumping unit 2 that is rotatably driven by a drive shaft of a motor not shown. The pumping unit includes an intake area 3.

In accordance with the invention, a hand pump unit 4 is provided, which is integrated into the pump housing 1, namely into a flow path 5 of pumping unit 2 on the intake side. More specifically, the hand pump unit 4 directly delivers into the intake area 3 of pumping unit 2, so that the flow paths between the hand pump unit 4 and the pumping unit 2 are minimized.

As can be noted from FIG. 1 in addition to the aforesaid characteristic features, the pump housing 1 connects to a pump flange 6. Furthermore, the pump housing 1 or pump flange 6 comprises a prefeed pump 7 as well as a pressure connection 8, to which reference is made merely for the sake of completeness.

As shown in FIGS. 1 and 2 together, the hand pump unit 4 projects from pump housing 1 with an actuation element 9, which is constructed as a hand knob and can be locked or screwed in place on a housing portion 10 of hand pump unit 4.

As furthermore shown in both Figures, the hand pump unit 4 includes an external suction inlet 11. In FIG. 2, the direction of inflow is indicated by an arrow 12. The suction inlet 11 is provided in the vicinity of actuation element 9, so that the flow paths are also minimized in this respect.

As can further be noted from FIG. 2, the hand pump unit 4 is constructed in the way of the pumping unit of an air pump, i.e., it comprises a cylinder-piston arrangement 13, which serves to deliver the fluid. By means of actuation element 9, it is possible to reciprocate a piston 14 in the hand pump unit 4 of pumping unit 2. This reciprocal movement may be orthogonal relative to axis of rotation 15. The orthogonal orientation, however, is not imperative. The piston 14 comprises a piston rod 16 as well as a displacement member 17 on the end side with a sealing lip 18 and a support bearing 19. In the position shown in FIG. 2, the piston 14 is in its idle position, with the actuation element 9 being screwed down. A cylinder chamber 20 serves as passageway for the fluid from suction inlet 11 to the intake area 3 of pumping unit 2. Via a suction chamber 21 provided in that area, the fluid enters pumping unit 2. From there, the fluid can be discharged via a pressure outlet 8 in the outflow direction indicated by arrow 22.

The embodiments specifically disclosed herein are not to be construed as limitations of the invention. Rather, within the scope of the present disclosure, numerous changes and modifications are possible, in particular such variants, elements, and combinations, and/or features, which a person of skill in the art is able to take, with respect to achieving an object, for example, from combining or modifying individual features, or elements, or procedural steps in connection with those described in the general specification and embodiments, as well as in the claims, and contained in the drawings, and which lead as a result of combined features to a new subject matter or to new process steps or sequences of process steps, also to the extent that they relate to production, examination, and operating methods.

What is claimed is:

1. A rotary pump for delivering a fluid, comprising:

a pump housing which includes an intake and an outlet, a rotary pumping unit mounted for rotation in said pump housing for delivering the fluid from said intake to said outlet, a hand pump unit integrally joined to the pump housing and having a discharge outlet which communicates with the intake of the pump housing, so that the hand pump unit can deliver the fluid into the intake of the pump housing, wherein the hand pump unit comprises a cylinder-piston arrangement which is configured to deliver the fluid to the intake of the housing, wherein the cylinder-piston arrangement includes a piston which is connected to an external actuation element so as to be manually reciprocable along an axis which is generally perpendicular to an axis of rotation of the rotary pumping unit, and wherein the piston is moveable by the actuation element to an idle position wherein a fluid is able to freely pass through the cylinder-piston arrangement and into the intake of the pump housing.

2. The rotary pump of claim 1 wherein the hand pump unit directly communicates with the intake of the pump housing.

3. The rotary pump of claim 1 wherein the pump housing further includes a pump flange for mounting the pump to a crankcase or the like, and wherein the hand pump unit is integrally connected to the pump flange.

4. The rotary pump of claim 1 wherein the actuation element projects from the pump housing.

5. The rotary pump of claim 4 wherein the actuation element is configured to be releasably locked in place in said idle position.

6. The rotary pump of claim 1 wherein the hand pump unit includes an external suction inlet.

7. The rotary pump of claim 6 wherein the external suction inlet is formed as an integral part of the hand pump unit.

8. The rotary pump of claim 6 wherein the external suction inlet is located to communicate with the cylinder-piston arrangement adjacent an end thereof which is opposite the intake of the pump housing.

9. A rotary pump for delivering a fluid, comprising:

a pump housing which includes an intake and an outlet, a rotary pumping unit mounted for rotation in said pump housing for delivering the fluid from said intake to said outlet, and a hand pump unit comprising a tubular cylinder having a suction inlet and a discharge outlet, with the cylinder being integrally joined to the pump housing so that the discharge outlet of the cylinder directly communicates with the intake of the pump housing, and a piston connected by a rod to a hand actuation member so as to be reciprocable in said cylinder between a raised position adjacent said suction inlet and a lowered idle position where the piston is spaced below the discharge outlet of the cylinder, and so that in the lowered idle position of the piston the fluid is free to flow through the cylinder from the suction inlet and into the intake of the pump housing.

10. The rotary pump of claim 9 wherein the rotary pumping unit comprises a rotary vane pump.

11. The rotary pump of claim 9 wherein the actuation element is configured to be releasably locked in place at said lowered idle position.

* * * * *